US006484985B1

(12) United States Patent
Heltzer

(10) Patent No.: US 6,484,985 B1
(45) Date of Patent: Nov. 26, 2002

(54) CLIP FOR PANEL SYSTEM

(75) Inventor: Michael Heltzer, Chicago, IL (US)

(73) Assignee: Heltzer Incorporated, Chicago, IL (US)

( * ) Notice: Subject to any disclaimer, the term of this patent is extended or adjusted under 35 U.S.C. 154(b) by 0 days.

(21) Appl. No.: 09/879,357

(22) Filed: Jun. 12, 2001

(51) Int. Cl.[7] ..... E04G 3/00
(52) U.S. Cl. ..... 248/220.43
(58) Field of Search ..... 248/220.31, 220.43, 248/221.11, 222.11, 220.21

(56) References Cited

U.S. PATENT DOCUMENTS 3,545,711 A * 12/1970 Scheneman ..... 248/243.1
5,913,499 A * 6/1999 Kiggins ..... 248/220.31 X
5,957,422 A * 9/1999 Shea ..... 248/220.31
5,984,118 A * 11/1999 Morrow ..... 248/220.4
6,234,436 B1 * 5/2001 Kump ..... 248/220.21

* cited by examiner

*Primary Examiner*—Ramon O. Ramirez
(74) *Attorney, Agent, or Firm*—McDonnell Boehnen Hulbert & Berghoff

(57) ABSTRACT

The clip of the present invention can be used to mount a number of different objects onto an associated panel system. Due to its design, the clip can be used either to support or carry a number of different objects. Thus, the same clip and panel system can be used to offer customized products for customers. Further, since the clip is provided with a tension control element that acts against the associated panel system when the clip is mounted on the panel, the clip ensures that an object is mounted securely on the panel.

16 Claims, 1 Drawing Sheet

CLIP FOR PANEL SYSTEM

FIELD OF THE INVENTION

The present invention is directed generally to a mounting device and specifically to a clip for mounting objects on a panel system.

BACKGROUND OF THE INVENTION

Mounting devices having various designs and functions are well-known. A shortcoming common to these known devices is their lack of versatility. Such devices are often limited to a single use or application. For example, such devices can be used to mount only one type of object. Thus, there is a need in the art for a mounting device that is versatile and therefore can be used for a number of different applications.

The known mounting devices suffer from yet another shortcoming. They are not provided with a tension control element to ensure the secure mounting of an object. Thus, there is a need in the art for a device that securely mounts objects on an associated panel system.

SUMMARY OF THE INVENTION

The present invention meets the shortcomings of the prior art by providing a clip that can be used to mount a number of different objects onto an associated panel system. Due to its design, the clip can be used either to support or carry a number of different objects. Thus, the same clip and panel system can be used to offer customized products to customers.

Further, the present invention meets the shortcomings of the prior art by providing a clip device having a tension control. Specifically, the clip includes a standard spring plunger that acts against the associated panel system when the clip is mounted on the panel. Thus, the clip with this spring plunger ensures that the object is mounted securely on the panel.

DETAILED DESCRIPTION OF THE INVENTION

Figure 1:
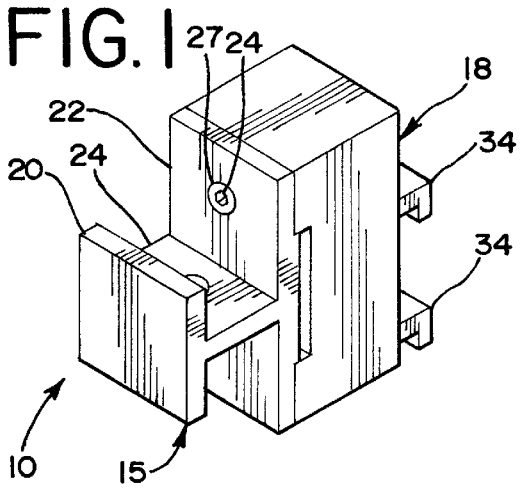
FIG. 1 is a perspective view of a clip made in accordance with the principles of the present invention.
Figure 2:
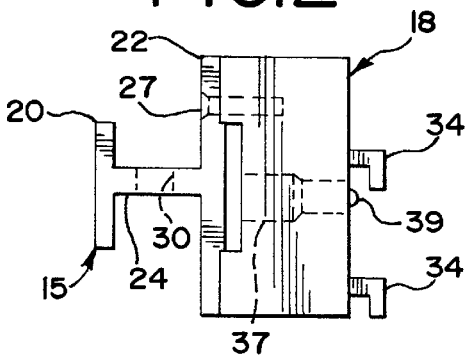
FIG. 2 is a side view of the clip of FIG. 1.

As depicted in FIGS. 1–6, the clip 10 of the present invention generally includes a first member 15 and a second member 18.

The first member 15 comprises two longitudinal members 20, 22 connected by a transverse member 24. In the preferred embodiment, the first member 15 is a unitary piece that is shaped like the letter H. Both members 15 and 18 are constructed of 6061-T6511 aluminum. Of course, the members may be constructed of any other suitable material such as different grade aluminum.

Figure 4:
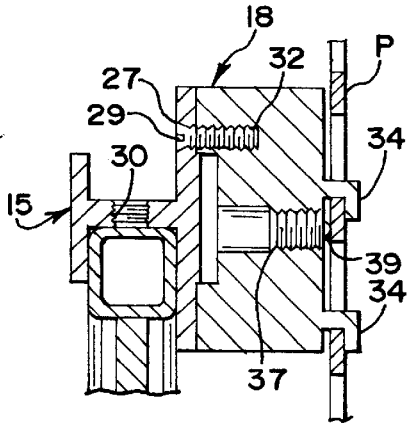
FIG. 4 is a cross-sectional view of the clip along line 4—4.
Figure 5:
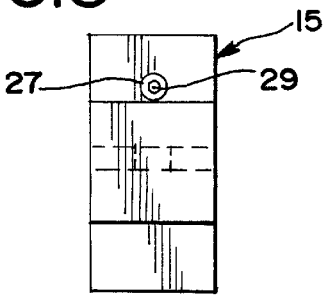
FIG. 5 is a front view of the clip of FIG. 1.
Figure 6:
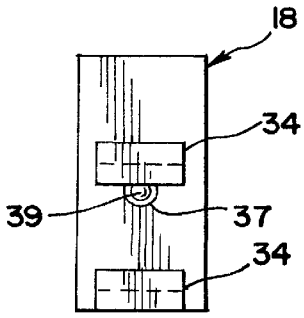
FIG. 6 is a back view of the clip of FIG. 1.

As can be seen in FIG. 4, the longitudinal member 22 is provided with a fastener hole 27 that accommodates a suitable fastener 29 for coupling the first member 15 to the second member 18. The transverse member 24 is provided with a similar fastener hole 30 that accommodates a suitable fastener to assist the clip 10 in supporting objects.

The second member 18 is provided with a fastener hole 32 that aligns with the fastener hole 27 of the first member 15 and accommodates fastener 29 therethrough for coupling the two members together. The second member 18 is further provided with a set of hooks 34 for mounting the clip 10 onto the panel P and a bore 37 that houses a standard spring plunger 39. The plunger 39 has a standard design that is commercially available. Once the hooks 34 are mounted onto the grid-like surface panel P, the panel P acts against the tip of the spring plunger 39 and pushes it slightly into the bore 37. The spring plunger 39 in turn reacts with an opposite force, which assists in keeping the clip 10 securely mounted on the panel P, thereby providing tension control.

Figure 3:
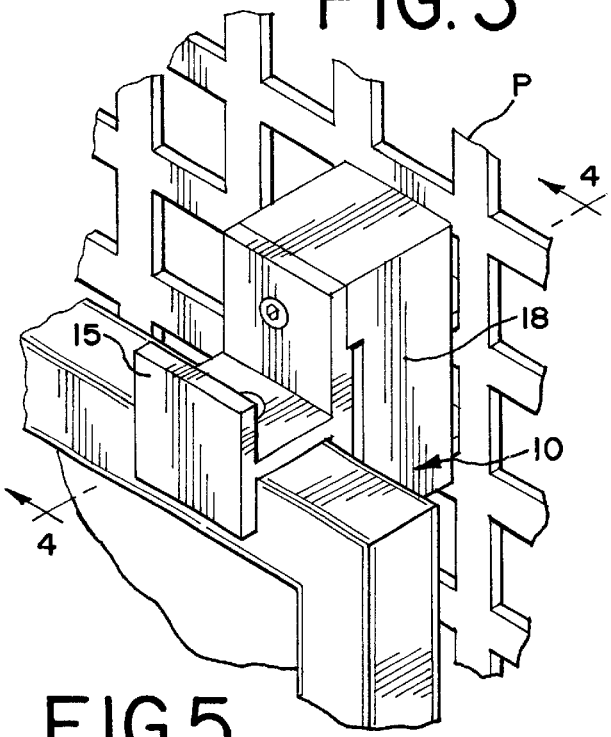
FIG. 3 a perspective view of the clip of FIG. 1 shown in use.

In use, the bore 27 of the first member 15 is aligned with the bore 32 of the second member 18, and the fastener 29 is inserted therethrough for coupling the two members together. As can be appreciated from FIG. 3, the function of the clip 10 is to support or carry various objects on a panel P, such as the KUBIS Panel System, available from Heltzer, Inc., Chicago, Ill. The clip 10 is versatile in that it may be used to support or carry any number of different objects on panel P. For example, the lower half portion of member 15 may be used to support the edge of a framed object such as a mirror or a chalkboard, as shown in FIG. 3. Alternately, the upper half portion of member 15 may be used to carry one end of a tool bar or shelf. It should be understood that a number of clips that are required to support or carry an object depends upon the object itself. A mirror or a chalkboard may require four clips, one adjacent each corner, while a tool bar or a shelf may require two clips, one at each end. The necessary number of clips are provided and then both the clips and the object are mounted on the grid-like surface of the panel. Fasteners may be provided in holes 30 to further assist in supporting the object.

As can be appreciated from the above discussion, the clip 10 allows the KUBIS panel system to be versatile. The same panel can be used to mount a mirror, a toothbrush rack, and a soap dish for use in a bathroom, or a kitchen tool bar and a spice rack for use in the kitchen. The customer can pick and choose what accessories are mounted on a particular panel. This versatility is enabled by the design of the clip. The clip is sturdy enough to carry the various objects, but can be mounted and removed from a panel easily. Additionally, the same clip can be used to mount any number of accessories on the panel. Thus, the same panel and clip can be used to offer customized products to customers.

As mentioned above, the first member 15 of the clip 10 has the shape of the letter H. This feature denotes to the customer that the clip is available from Heltzer, Inc., Chicago, Ill. Thus, the shape of the clip serves as advertising for the clip and its associated panel.

While the invention has been described in connection with certain embodiments, it should be understood that it is not intended to limit the invention to these particular embodiments. To the contrary, it is intended to cover all alternatives, modifications and equivalents falling within the spirit and scope of the invention.

What is claimed is:

1. A clip for mounting an object onto a panel comprising a first member for supporting an object; and a second member coupled to the first member and having a plurality of hooks for mounting the object onto a panel, the second member further comprising a bore defined therethrough and a spring plunger housed within the bore, wherein the clip may be used to mount a number of different objects onto the panel.

2. The clip of claim 1 wherein the first member has the shape of the letter H.

3. The clip of claim 1 wherein the first member comprises two longitudinal members connected by a traverse member.

4. The clip of claim 1 wherein the first member and the second member are each provided with a fastener hole.

5. The clip of claim 4 further comprising a fastener that is accommodated within the fastener holes of the first and second members for coupling the members together.

6. A clip for mounting an object onto a panel comprising a first member for supporting an object, the first member having the shape of the letter H; and a second member coupled to the first member and having a plurality of hooks for mounting the object onto a panel, wherein the clip may be used to mount a number of different objects onto the panel.

7. A combination of a clip and panel comprising:

a panel having a grid surface; and at least one clip for supporting an object and mounting the object onto the panel, the clip further comprises a first member for supporting the object; and a second member coupled to the first member and having a plurality of hooks for mounting the object onto the panel, the second member further comprising a bore defined therethrough and a spring plunger accommodated within the bore.

8. The combination of claim 7 wherein the clip may be used to support a number of different objects on the panel.

9. The combination of claim 7 wherein the first member has the shape of the letter H.

10. The combination of claim 7 wherein the first member comprises two longitudinal members connected by a traverse member.

11. The combination of claim 7 wherein the hooks of the second member mate with the grid surface of the panel.

12. The combination of claim 7 wherein the first member and the second member are both provided with a fastener hole.

13. The combination of claim 12 further comprising a fastener that is accommodated with the fastener holes of the first and second members to couple the members together.

14. A clip for mounting an object onto a panel comprising a first member for supporting an object, the first member comprising two longitudinal members connected by a traverse member; and a second member coupled to the first member and having a plurality of hooks for mounting the object onto a panel, wherein the clip may be used to mount a number of different objects onto the panel.

15. A combination of a clip and panel comprising:

a panel having a grid surface; and at least one clip for supporting an object and mounting the object onto the panel, the clip further comprises a first member for supporting the object, the first member having the shape of the letter H; and a second member coupled to the first member and having a plurality of hooks for mounting the object onto the panel.

16. A combination of a clip and panel comprising:

a panel having a grid surface; and at least one clip for supporting an object and mounting the object onto the panel, the clip further comprises a first member for supporting the object, the first member comprises two longitudinal members connected by a traverse member; and a second member coupled to the first member and having a plurality of hooks for mounting the object onto the panel.

* * * * *